US009599389B2

(12) United States Patent
Bortoletto et al.

(10) Patent No.: US 9,599,389 B2
(45) Date of Patent: Mar. 21, 2017

(54) ICEMAKER WITH SWING TRAY

(71) Applicant: Whirlpool Corporation, Benton Harbor, MI (US)

(72) Inventors: Anderson Bortoletto, Waunakee, WI (US); Kevin M. Chase, St. Joseph, MI (US); Tony L. Koenigsknecht, Chicago, IL (US); Ronald L. Voglewede, St. Joseph, MI (US); Matthew E. Young, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/590,089

(22) Filed: Jan. 6, 2015

(65) Prior Publication Data

US 2015/0107276 A1 Apr. 23, 2015

Related U.S. Application Data

(63) Continuation of application No. 13/166,125, filed on Jun. 22, 2011, now Pat. No. 8,950,197.

(51) Int. Cl.

| | |
|---|---|
| ***F25C 1/18*** | (2006.01) |
| ***A23G 9/00*** | (2006.01) |
| ***F25C 1/00*** | (2006.01) |
| ***F25C 5/10*** | (2006.01) |
| ***F25C 1/20*** | (2006.01) |
| ***F25C 1/10*** | (2006.01) |
| ***F25C 1/24*** | (2006.01) |

(52) U.S. Cl.

CPC ..... *F25C 1/20* (2013.01); *F25C 1/10* (2013.01); *F25C 1/24* (2013.01); *F25C 2305/022* (2013.01); *F25C 2700/12* (2013.01)

(58) Field of Classification Search

CPC ..... F25C 1/08; F25C 1/12; F25C 1/18; F25C 1/20

USPC ..... 62/66–68, 73, 348, 352, 353, 356, 345

See application file for complete search history.

(56) References Cited

U.S. PATENT DOCUMENTS

| | | | | |
|---|---|---|---|---|
| 4,184,339 | A * | 1/1980 | Wessa | 62/68 |
| 4,869,076 | A * | 9/1989 | Sakai et al. | 62/347 |
| 5,212,957 | A * | 5/1993 | Ruff | 62/124 |
| 7,617,693 | B2 * | 11/2009 | Lee | 62/135 |
| 2004/0226311 | A1 * | 11/2004 | Ishitomi et al. | 62/348 |
| 2008/0156025 | A1 * | 7/2008 | Shin et al. | 62/349 |
| 2010/0139295 | A1 * | 6/2010 | Zuccolo et al. | 62/68 |
| 2011/0265498 | A1 * | 11/2011 | Hall | 62/73 |

* cited by examiner

*Primary Examiner* — Ryan J Walters
*Assistant Examiner* — Joseph Trpisovsky

(57) ABSTRACT

A clear ice making system and method utilizes an ice forming tray pivotally connected to opposing side walls of an icemaker housing. Ice forming fingers of a dedicated evaporator extend into fluid within the ice forming tray, and are cooled by communication with the refrigerant circulating system of the refrigerator. A motor oscillates the ice forming tray about a longitudinal axis at a frequency of about 0.4-0.6 hertz as fluid channels freezes on the ice forming fingers over time, forming clear ice pieces. During an ice dispensing event, the motor pivots the ice making tray about the longitudinal axis such that fluid remaining within the ice making tray drains into a fluid reservoir below. The ice forming fingers are then heated to release the clear ice pieces for transfer from the fresh food compartment to the freezer compartment of the refrigerator.

20 Claims, 5 Drawing Sheets

ICEMAKER WITH SWING TRAY

CROSS-REFERENCE TO RELATED APPLICATIONS

This application represents a continuation application of U.S. application Ser. No. 13/166,125, filed Jun. 22, 2011.

BACKGROUND OF THE INVENTION

Field of the Invention

The present invention pertains to the art of icemakers and, more particularly, to clear icemakers.

Description of the Related Art

In general, ice pieces produced with standard icemakers tend to include air bubbles or other imperfections that lend a cloudy or impure appearance to the ice. Therefore, there has been an interest in constructing icemakers which produce clear ice pieces. One approach to preventing the formation of cloudy ice is to slowly form ice pieces from the inside outward, utilizing cooling rods or fingers around which the pieces form as set forth in U.S. Pat. No. 7,406,838. Specifically, an evaporator includes cooling fingers that extend into a water tray. In order to harvest ice pieces formed on the tips of the cooling fingers, a holding plate located on a front wall of the tray is released, and the tray swings or pivots about side pivots to dump water within the tray into a water trough. The fingers are then heated in order to release the formed ice pieces, which are guided by a push plate extending from the tray, into an ice box located in front of the icemaker as the tray returns to its ice making position. However, this device is specifically designed to be located outside of a domestic refrigerator, and the ice pieces are formed in stagnant water within the tray. Air bubbles tend to collect on the fingers, leading to diminished ice clarity.

Another method for producing clear ice pieces involves moving an ice forming tray during the production of ice pieces in order to allow entrapped gases in the water to escape, as is demonstrated by U.S. Patent Application Publication No. 2010/0139295. Specifically, paddles extending into a tray cause water within the tray to agitate as the tray moves about an axis. However, such a tray is more costly to make and adds to the complexity of the system. It is also unclear how such a system actually dispenses ice, although the '295 publication does teach that ice is dispensed into a storage container below such that, when the icemaker is mounted in a fresh food compartment, the ice pieces are exposed to the lower temperature of the fresh food compartment and will melt over time.

Regardless of these known prior art arrangements, there is seen to be a need in the art for an improved compact icemaker that can be utilized with various refrigerator configurations to produce high quality clear ice pieces utilizing minimal amounts of water.

SUMMARY OF THE INVENTION

The present invention is directed to a clear ice making system and method for a refrigerator which utilizes a swinging ice forming tray. More specifically, opposing side portions of the ice forming tray are pivotally connected to opposing side walls of an icemaker housing. Ice forming fingers of a dedicated evaporator extend into the ice forming tray and are cooled by communication with the refrigerant circulating system of the refrigerator. During an ice making cycle, a predetermined amount of fluid is supplied to the ice forming tray, and a motor controller operates a motor to oscillate the ice forming tray about a longitudinal axis at a frequency of about 0.4-0.6 hertz (Hz). Thin layers of ice form about each of the ice forming fingers and build-up over a period of time to produce clear ice pieces of a desired size. Upon initiation of an ice dispensing event, the motor controller operates the motor to swing or pivot the ice making tray about the longitudinal axis such that any fluid remaining within the ice making tray drains via gravity from the tray into a fluid reservoir below.

During an ice harvest event, the ice forming members are heated to release ice pieces formed thereon, and the ice pieces are released from the icemaker. In a preferred embodiment, the icemaker is located with a fresh food compartment of the refrigerator. After ice pieces are released from the icemaker, they are transferred from the fresh food compartment to an ice storage bucket located in a freezer compartment of the refrigerator. After a predetermined period of time or after a predetermined number of ice making cycles, fluid from within the fluid reservoir is drained and a fresh supply of fluid is added to the ice forming apparatus. At the end of the ice harvesting event, the motor controller operates the motor to pivot the ice making tray back to an ice making position. A pump is utilized to recirculate fluid from the fluid reservoir to the ice making tray to being a new ice making cycle.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
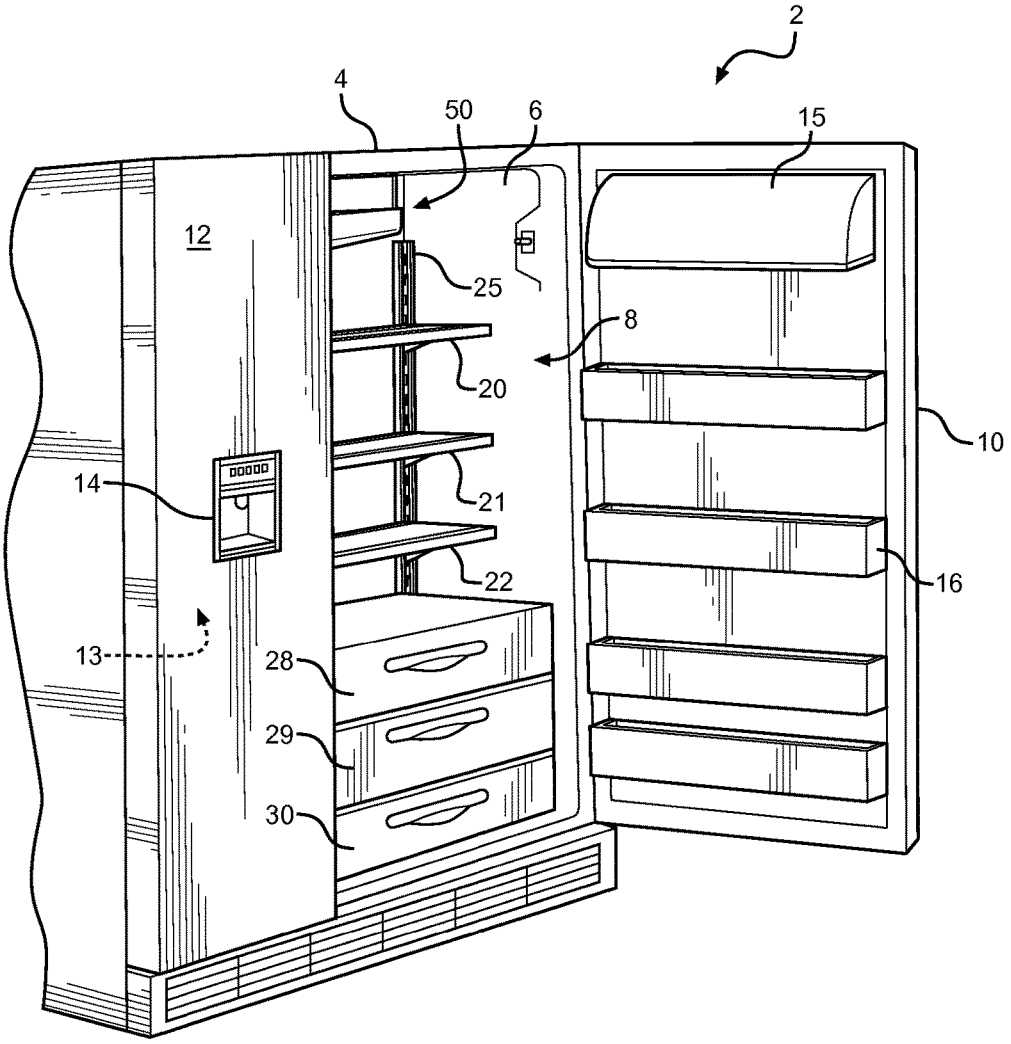
FIG. 1 is a perspective view of a refrigerator including an ice making system of the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically, height adjustable shelves 20-22 supported by a pair of shelf support rails, one of which is indicated at 25. At a lowermost portion of fresh food compartment 8 is illustrated various vertically spaced bins 28-30. At this point, it should be recognized that the above described refrigerator structure is known in the art and presented only for the sake of completeness. The present invention is not limited for use with a side-by-side style refrigerator shown, but may be utilized with other known refrigerator styles including top-mount, bottom-mount, or French door freezer styles. Instead, the present invention is particularly directed to a clear ice making assembly which is generally indicated at 50.

Figure 2:
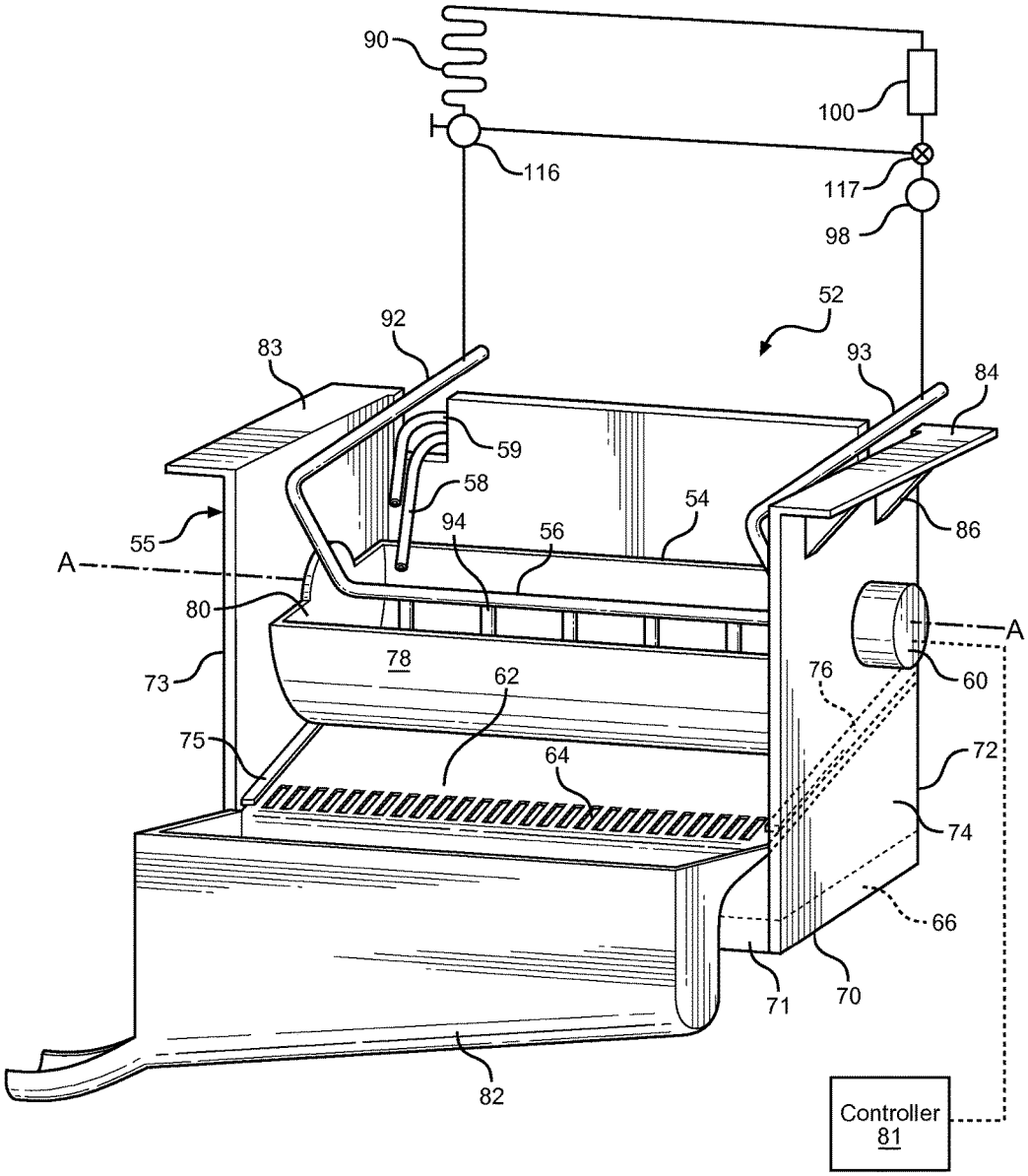
FIG. 2 is a front perspective view an icemaker of the present invention with a schematic view of a refrigerant circulating system utilized in conjunction with the invention.

Details of an icemaker 52 utilized in the clear icemaker system 50 will now be discussed with reference to FIG. 2. Icemaker 52 includes an ice forming tray 54 rotatably mounted to a housing 55, a dedicated evaporator member 56 mounted to housing 55 in a fixed or stationary manner, first and second fluid inlet lines 58 and 59 for providing water to ice forming tray 54, a tray motor 60, an ice slide 62 including a plurality of drainage apertures 64 formed therein and a fluid reservoir indicated at 66. In the preferred embodiment shown, housing 55 includes bottom, front, back, and opposing side walls 70-74, and first and second sets of mounting flanges 75 and 76 located on each of the opposing side walls 73 and 74. Ice forming tray 54 includes a bottom portion 78 and opposing side portions, one of which is shown at 80. Bottom portion 78 and opposing side portions 80 define a trough (not separately labeled) in which fluid is retained during an ice making event. In the preferred embodiment shown, bottom portion 78 has an arcuate shape. Opposing side portions 80 of ice forming tray 54 are mounted to respective opposing side walls 73 and 74 of housing 55 through stub shafts (not shown) for pivotal movement of ice forming tray 54 about a longitudinal axis A. Motor 60 is connected to ice forming tray 54, and includes a motor controller indicated at 81 configured to oscillate the ice forming tray about axis A at a frequency of 0.4-0.6 Hz during an ice making event, and to pivot the ice forming tray from a first, ice forming position to a second, ice dispensing position during an ice dispensing event, as will be discussed in more detail below. At this point it should be recognized that motor 60 may directly drive tray 54, such as through one of the stub shafts (not shown), or can indirectly drive try 54, such as through a system of meshed gears, belts or the like (not shown).

In a preferred embodiment, ice slide 62 is formed separately from housing 55. With this configuration, ice slide 62 is slid between respective sets of mounting flanges 75 and 76 and is held in place between fluid reservoir 66 and ice forming tray 54 at a downwardly sloping acute angle with respect to back wall 72. Fluid reservoir 66 is defined by bottom, front, back and opposing side walls 70-74 such that ice slide 62 forms a downwardly sloping cover for fluid reservoir 66. Additionally, ice slide 62 is connected to an ice transfer chute 82 such that ice dispensed from icemaker 52 during a dispensing event slides down ice slide 62 (via gravity) and enters ice transfer chute 82. Housing 55 also preferably includes mounting flanges 83 and 84 extending substantially perpendicularly from respective opposing side walls 73 and 74, with flanges 83 and 84 being reinforced by gussets indicated at 86. Icemaker 52 may be mounted to top wall (not separately labeled) of refrigerator 2 through mounting flanges 83 and 84 using conventional fastening means such as screws or the like or, alternatively, may be mounted within refrigerator 2 through though other structure, such as bottom wall 70 or back wall 72.

Icemaker 52 is adapted to be connected to a refrigerant circulating system of refrigerator 2. As depicted in FIG. 2, a refrigerator evaporator 90 in the refrigerant circulating system of refrigerator 2 is in fluid communication with evaporator member 56 through refrigerant inlet and outlet lines 92 and 93. In accordance with the present invention, ice forming fingers 94 extending from evaporator member 56 are preferably chilled through direct contact with refrigerant, such as the flow of refrigerant through hollow portions (not shown) of ice forming fingers 94. Alternatively, ice forming fingers 94 may be chilled through indirect contact with refrigerant flowing through evaporator member 56 (i.e., via conduction). Evaporator member 56 is made from one or more highly heat conductive materials, e.g., copper, such that cooled refrigerant circulating through evaporator member 56 rapidly cools ice forming fingers 94 to ice forming temperatures. Refrigerant then circulates through a compressor 98 and condenser 100 before circulating back through an expansion device (not shown) and on to refrigerator evaporator 90.

Figure 3A:
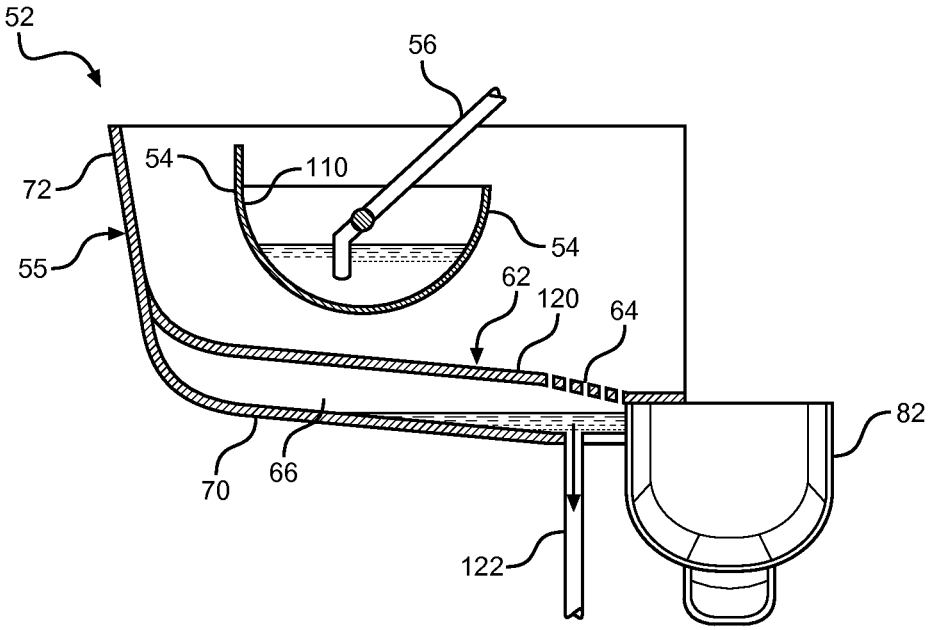
FIG. 3A is partial cross-sectional side view of an icemaker of the present invention in an ice producing mode.

Various methods of initiating an ice making cycle are known in the art, including providing a controller for initiating an ice making cycle based on the amount of ice stored within an ice bucket. In accordance with the present invention, a known method of initiating an ice making cycle may be utilized, and such details are not considered to be part of the present invention. Instead, the invention is particularly directed to the structure of clear ice making assembly 50 and the manner in which ice pieces are produced and dispensed, which will now be discussed in more detail with reference to FIGS. 3A and 3B. Upon initiation of an ice making event, a predetermined amount of water is supplied to ice forming tray 54 via one of the first and second fluid inlet lines 58 and 59. As will be discussed in more detail below, first fluid inlet line 58 is a fresh water inlet line which is connected to a water source in a manner known in the art, while second fluid inlet line 59 is a fluid recycling line supplying fluid from fluid reservoir 66. Evaporator member 56 is cooled in the manner described above, and ice pieces form on each of the plurality of ice forming fingers 94 over time.

It should be noted that a smooth ice forming tray, such as ice forming tray 54, provides challenges regarding water circulation within the tray. Specifically, depending on the rates of rotation, it has been found that stationary waves may be generated that do not promote removal of air bubbles from the surface of ice forming fingers 94. In accordance with the present invention, during a freezing or ice forming cycle, motor 60 is specifically configured to rotate ice forming tray 54 about longitudinal axis A to oscillate ice making tray 54 at a predetermined frequency. More specifically, it was discovered that oscillating ice forming tray 54 at a frequency range of between about 0.4-0.6 Hz significantly enhances the prevention of air bubbles forming in the ice established on stationary ice forming fingers 94 during an ice making cycle. With this configuration, ice forming tray 54 can have a substantially smooth, continuous arcuate inner wall indicated at 110, particularly without any deflectors or baffles utilized by prior art devices to promote fluid circulation within a tray. The present structure simplifies manufacturing and enables fluid to be more effectively drained from ice forming tray 54 by simply rotating the ice forming tray 54 approximately 90 degrees from an ice forming position, wherein fluid is retained in ice forming tray 54, to an ice dispensing position, wherein fluid drains via gravity from ice forming tray 54.

Figure 4:
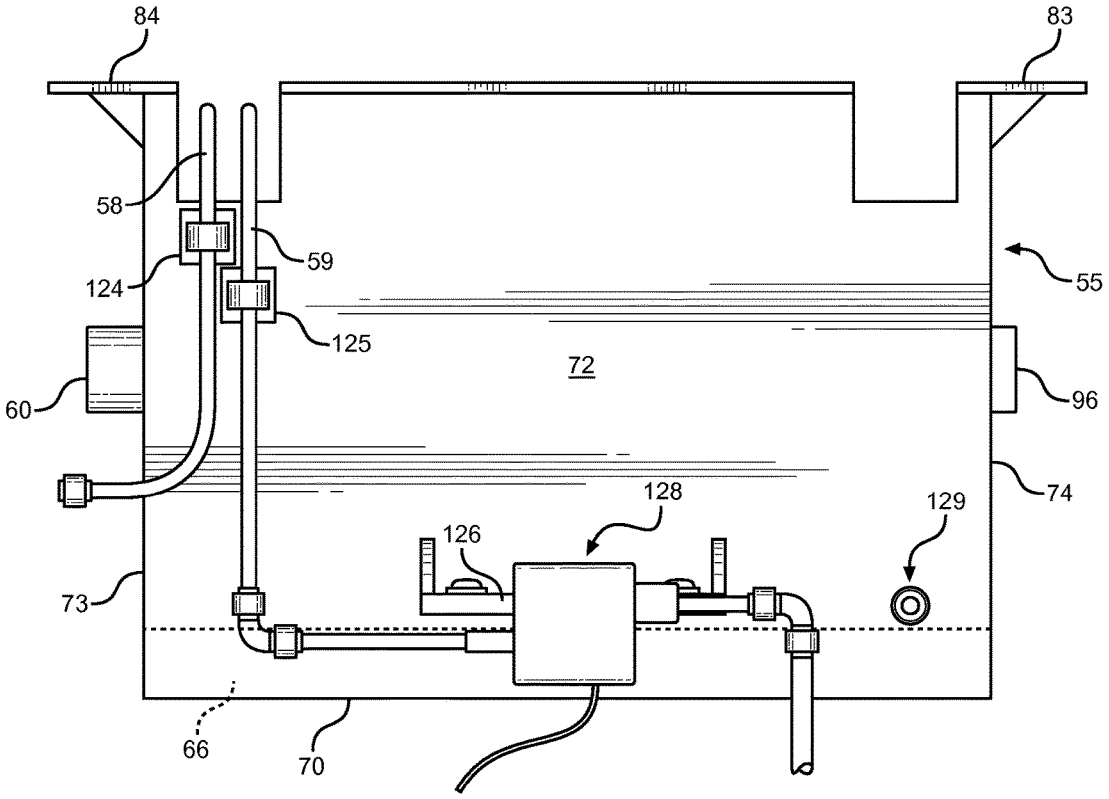
FIG. 4 depicts a back view of the icemaker of FIG. 2.

After a predetermined amount of time, or based on another known method for determining the end of an ice production cycle, evaporator member 56 is heated to melt the portions of the ice pieces in direct contact with ice forming fingers 94 in order to release clear ice pieces of a desired size therefrom. A potentiometer indicated at 96 in FIG. 4, is in communication with ice making tray 54 and is utilized to sense and provide feedback regarding the angle of ice making tray 54 with respect to housing 55. More specifically, potentiometer 96 communicates the angle of ice making tray 54 to motor controller 60 to aid in the proper rotation of ice making tray 54 during ice making and ice dispensing events. Heating of evaporator member 56 may be accomplished through the use of a heating element (not shown), such as an electric resistive heating element positioned in heating relationship with evaporator member 56, or through the use of heated refrigerant circulated through evaporator member 56. Preferably, one or more valves indicated at 116 and 117 in FIG. 2 is/are actuated to direct heated refrigerant gas from compressor 98 through evaporator member 56 in order to heat fingers 94 during an ice harvesting cycle. Such harvesting methods are known in the art and, therefore, will not be discussed in detail herein. See, for example, U.S. Pat. Nos. 5,212,957 and 7,587,905, which are incorporated by reference herein.

Figure 3B:
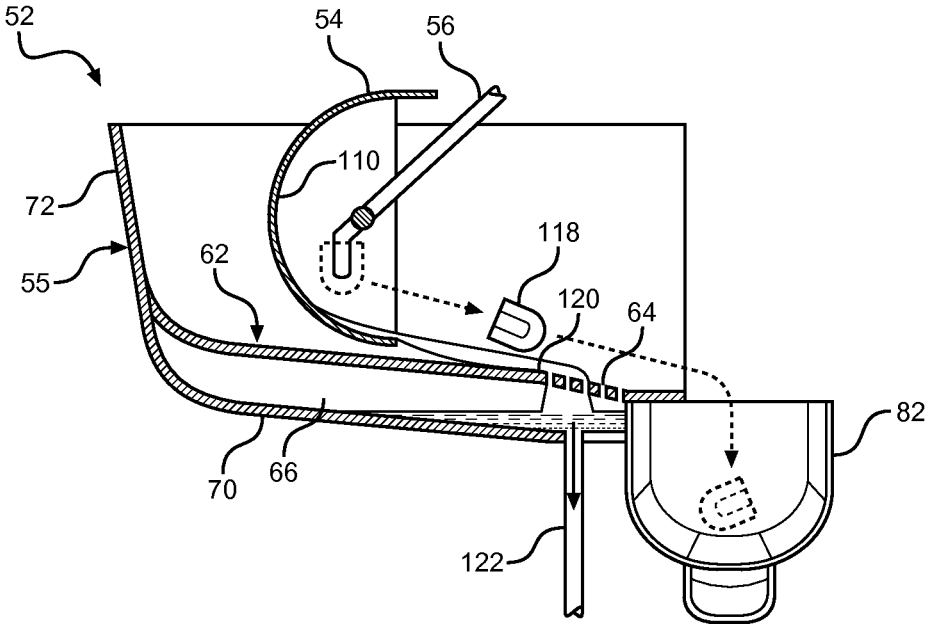
FIG. 3B is a partial cross-sectional side view of the icemaker of FIG. 3A in a dispensing mode.

With particular reference to FIG. 3B, clear ice pieces 118 released from fingers 94 slide down smooth inner wall 110, onto a sloped upper surface 120 of ice slide 62, and down past drainage apertures 64 into ice transfer chute 82. Any fluid remaining in ice forming tray 54 also runs down sloped upper surface 120 and drains through drainage apertures 64 into fluid reservoir 66. At the end of an ice harvesting cycle, motor 60 is utilized to return ice making tray 54 to its original ice making position depicted in FIG. 3A. The second fluid inlet 59, or recycling line, is utilized to recycle fluid within the system as will be discussed in more detail below.

With initial reference to FIG. 4, housing 55 includes mounting brackets 124 and 125 for securing first and second fluid inlet lines 58 and 59 thereto. Similarly, a mounting bracket 126 is provided for securing a pump 128 to back wall 72 of housing 55. Second fluid recycling line 59 is in fluid communication with pump 128. During the start of an ice making event, pump 128 is actuated, and fluid from fluid reservoir 66 is pumped through second fluid inlet line 59 into ice forming tray 54. An overflow protection device indicated at 129 is also provided. Basically, overflow protection device 129 is defined by a drain hole linked through a hose to a fluid drain zone (not shown) within the refrigerator in order to prevent the inadvertent overfill of fluid reservoir 66.

Figure 5:
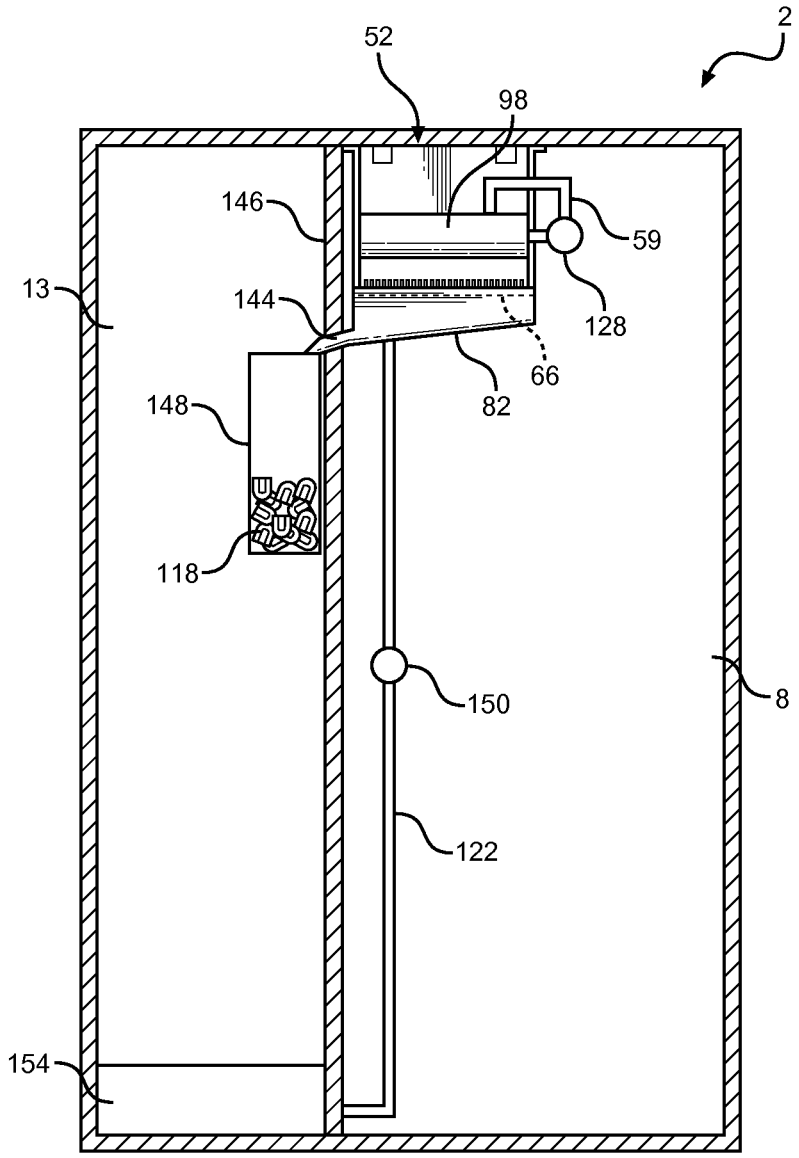
FIG. 5 depicts a fluid circulation system utilized in the present invention.

In a preferred embodiment depicted in FIG. 5, ice pieces 130 released from fingers 94 will be guided by gravity into ice transfer chute 82, where the ice pieces 130 will be further guided by gravity through an aperture 144 located in an insulated wall 146 separating the fresh food and freezer compartments 8 and 13, and into an ice storage bucket 148 located in the freezer compartment 13. As discussed above, during initiation of the ice forming event, water collected in fluid reservoir 66 is pumped into ice forming tray 54 via second fluid supply line 59. Alternatively or additionally, fresh water may also be supplied to ice forming tray 54 at initiation of the ice forming event through first fluid supply line 58. Preferably, water from fluid reservoir 66 is recycled a predetermined number of times before a drain valve 150 is actuated, and fluid reservoir 66 is emptied through drain line 122 to a drain or condensate pan indicated at 154. Fresh fluid is then supplied to icemaker 52 through first fluid inlet line 58 (shown in FIG. 3). The combination of ice forming tray 54, fluid reservoir 66, and the fluid recycling method utilized allows clear ice making assembly 50 to employ minimal amounts of fluid in the production of ice pieces, preferably approximately 500 ml per ice making cycle.

As discussed above, the icemaker of the present invention includes its own dedicated ice forming evaporator which is adapted to connect to the refrigerator circulating system of any type of refrigerator unit. With this modular configuration, the icemaker can be placed anywhere within a refrigerator. The result is an ice making system that has wide range of applications and utilizes minimal amounts of fluid to form clear ice pieces, which are preferably stored in a freezer compartment to prevent wasteful melting of the ice pieces over time.

Although described with reference to preferred embodiments of the invention, it should be readily understood that various changes and/or modifications can be made to the invention without departing from the spirit thereof. For instance, although the ice transfer chute is shown transferring ice into the freezer compartment, it should be understood that ice pieces could be directed into the fresh food compartment for storage, or guided to a container in one of the fresh food or freezer doors. In general, the invention is only intended to be limited by the scope of the following claims.

What is claimed is:

1. A refrigerator comprising:

a cabinet including a fresh food compartment and a freezer compartment;

a refrigerant circulating system; and a clear ice making system comprising:

a housing including at least bottom and opposing side walls;

an ice forming tray including a bottom portion, defined by a substantially smooth, continuous arcuate inner wall, and opposing, longitudinally spaced side portions, said ice forming tray being mounted in the cabinet for pivotal movement about a longitudinal axis;

a motor connected to the ice forming tray;

a motor controller configured to operate the motor to oscillate the ice forming tray about the longitudinal axis during an ice making event and to pivot the ice forming tray from a first, ice forming position to a second, ice dispensing position during an ice dispensing event, wherein oscillating the ice forming tray includes rotating the ice forming tray about the longitudinal axis; and an evaporator member including refrigerant inlet and outlet lines in communication with the refrigerant circulating system, the evaporator member further including a plurality of ice forming fingers extending into the ice forming tray when the ice forming tray is in an ice forming position.

2. The refrigerator of claim 1, further comprising: at least one fluid inlet line exposed to the ice forming tray for directly introducing water to the ice forming tray.

3. The refrigerator of claim 2, wherein the at least one fluid inlet line constitutes two separate inlet lines directly exposed to the ice forming tray.

4. The refrigerator of claim 1, wherein the clear ice making system further comprises:

a fluid reservoir located below the ice forming tray; and a pump connected to the fluid reservoir for providing water from the fluid reservoir to the ice forming tray.

5. The refrigerator of claim 4, wherein the pump is mounted on the back wall of the housing through a mounting bracket.

6. The refrigerator of claim 4, wherein the clear ice making system further comprises:

an ice storage bucket located in the freezer compartment; and an ice transfer chute located beneath an ice slide, wherein the housing is located within the fresh food compartment, and the ice transfer chute is adapted to transfer clear ice pieces dispensed from the clear ice making system from the fresh food compartment to the freezer compartment.

7. The refrigerator of claim 1, wherein the clear ice making system further comprises:

a fluid reservoir located below the ice forming tray; and an ice slide positioned between the ice forming tray and the fluid reservoir, the ice slide including drain apertures therein in fluid communication with the fluid reservoir.

8. The refrigerator of claim 7, wherein the housing further comprises mounting flanges located on each of the opposing side walls of the housing, the mounting flanges engaging the ice slide to hold the ice slide at a downwardly sloping acute angle such that clear ice pieces released from each of the plurality of ice forming fingers during the ice dispensing event are guided by gravity down the ice slide for storage within the refrigerator.

9. The refrigerator of claim 7, wherein the ice slide slopes downwardly sloping from a back wall of the housing beneath the ice forming tray.

10. The refrigerator of claim 1, wherein the housing further comprises mounting flanges extending substantially perpendicularly from respective opposing side walls of the housing, wherein the housing is mounted to a top wall portion of the fresh food compartment through the mounting flanges.

11. The refrigerator of claim 1, wherein the motor controller is configured to operate the motor to oscillate the ice forming tray about the longitudinal axis at a frequency of 0.4-0.6 Hz.

12. A method of forming clear ice pieces within a refrigerator with an ice making system including a housing with at least bottom and opposing side walls, an ice forming tray defined by a substantially smooth, continuous arcuate inner wall and mounted for pivotally movement about a longitudinal axis relative to the housing, and an evaporator member including a plurality of ice forming fingers, the method comprising:

supplying water to the ice forming tray with the ice forming tray in an ice forming position and the ice forming fingers of the evaporator member extending into the ice forming tray;

oscillating the ice forming tray about the longitudinal axis, causing the ice forming fingers to move through the water, wherein oscillating the ice forming tray includes rotating the ice forming tray about the longitudinal axis; and cooling the plurality of ice forming fingers such that clear ice pieces form on the plurality of ice forming fingers over a period of oscillation time.

13. The method of claim 12, wherein the step of supplying water to the ice forming tray includes pumping water from a fluid reservoir to at least one fluid inlet line for directly introducing the water to the ice forming tray.

14. The method of claim 13, wherein supplying the water to the ice forming tray includes supplying the water through at least two separate inlet lines directly exposed to the ice forming tray.

15. The method of claim 12, further comprising:

rotating the ice forming tray from the ice forming position to an ice dispensing position wherein water remaining in the ice forming tray, after the clear ice pieces form, drains from the ice forming tray; and heating the plurality of ice forming fingers to partially melt the clear ice pieces formed on the plurality of ice forming fingers to release the clear ice pieces from the plurality of ice forming fingers.

16. The method of claim 15, further comprising:

transferring the clear ice pieces down a sloped upper surface of an ice slide located below the ice forming tray.

17. The method of claim 16, further comprising:

draining water, through drain apertures formed in the ice slide, to a fluid reservoir.

18. The method of claim 16, further comprising:

transferring the clear ice pieces, released from the plurality of ice forming fingers, across the ice slide and through an ice transfer chute, to an ice storage bucket.

19. The method of claim 18, wherein the housing and evaporator member are located within a fresh food compartment of the refrigerator and the ice storage bucket is located in a freezer compartment of the refrigerator, and the ice transfer chute transfers the clear ice pieces released from the plurality of ice forming fingers through a wall separating the fresh food and freezer compartments to the ice storage bucket.

20. The method of claim 12, wherein the ice forming tray is oscillated about the longitudinal axis at a frequency of 0.4-0.6 Hz.

* * * * *